US008112944B2

(12) United States Patent
Miller et al.

(10) Patent No.: US 8,112,944 B2
(45) Date of Patent: Feb. 14, 2012

(54) PRE-ENGINEERED BUILDING FOR AN INTEGRAL MOBILE IMAGING UNIT

(75) Inventors: William G. Miller, Stafford Springs, CT (US); Robert F. Currie, North Granby, CT (US)

(73) Assignee: William G. Miller, Stafford Springs, CT (US)

( * ) Notice: Subject to any disclaimer, the term of this patent is extended or adjusted under 35 U.S.C. 154(b) by 524 days.

(21) Appl. No.: 12/290,072

(22) Filed: Oct. 27, 2008

(65) Prior Publication Data

US 2010/0101154 A1 Apr. 29, 2010

(51) Int. Cl.
*E04H 3/00* (2006.01)

(52) U.S. Cl. ..... 52/79.7; 52/79.1; 52/175

(58) Field of Classification Search ..... 52/79.1–79.9, 52/174, 175, 2.12
See application file for complete search history.

(56) References Cited

U.S. PATENT DOCUMENTS 2,840,866 A * 7/1958 Paulsen ..... 52/67
4,499,696 A * 2/1985 Freeauf ..... 52/79.8
4,900,217 A * 2/1990 Nelson ..... 414/537
4,912,796 A * 4/1990 Crump ..... 14/69.5
6,330,766 B1 * 12/2001 Brownlee, III ..... 52/173.1
6,401,477 B1 * 6/2002 Dube ..... 62/298
6,996,478 B2 * 2/2006 Sunshine et al. ..... 702/22
2002/0129566 A1 * 9/2002 Piccolo et al. ..... 52/79.1
2006/0059792 A1 * 3/2006 Tiramani ..... 52/79.1

* cited by examiner

*Primary Examiner* — Brian Glessner
*Assistant Examiner* — Adam Barlow
(74) *Attorney, Agent, or Firm* — Malcolm J. Chisholm, Jr.

(57) ABSTRACT

A pre-engineered building (50) includes a patient service enclosure (62) and a mobile imaging unit enclosure (64) sharing a common wall (66) to seamlessly wrap a mobile imaging unit (18, 56) within the mobile imaging unit enclosure (64) of the building (50), thereby providing patient service rooms (94) integral with an adjacent the mobile imaging unit (18, 56). Walls (66, 70, 72, 74, 84, 86, 88) of the building (50) are pre-engineered so that the walls (66, 70, 72, 74, 84, 86, 88) are manufactured in panelized configurations that may include structural support components, exterior sheathing, and utility components prior to installation of the walls (66, 70, 72, 74, 84, 86, 88) upon a foundation (58) supporting the pre-engineered building (50).

2 Claims, 10 Drawing Sheets

PRE-ENGINEERED BUILDING FOR AN INTEGRAL MOBILE IMAGING UNIT

TECHNICAL FIELD

The present invention relates to pre-engineered structures, and particularly relates to a pre-engineered building for housing and making use of a mobile imaging unit, such as a mobile modality of Magnetic Resonance Imaging (MRI) unit and associated administrative and clinical space.

BACKGROUND OF THE INVENTION

Mobile diagnostic imaging units are designed to house multi-modality diagnostic scanners, i.e. CAT-scan (CT) or Magnetic Resonance Imaging (MRI) and Positron Tomography (PET) or Positron Tomography/Computerized Tomography (PET/CT) apparatus secured within a trailer capable of being moved along roadways to various locations. By having such modern medical resources available as mobile units, medium and smaller sized medical facilities often in remote or thinly populated regions may offer cutting edge technology to their patients without the expense of outright purchasing of such modern and costly medical resources. Mobile units also make it possible for facilities to provide additional scan services for backlogs or when upgrades take place. Additionally, their facilities do not have to be re-constructed to house such complex medical equipment as PET/CT or MRI modalities. Moreover, as the technology of such PET/CT scanners and MRI imaging resources improves, the medical facilities do not have to invest the substantial capital to be constantly upgrading their facilities to accommodate such improved equipment. Instead, the mobile imaging units are upgraded, and thereby simply bring improved imaging technology to the various medical facilities that utilize mobile imaging units.

It is common that one mobile imaging unit may be at one medical facility for daily services or can be for incremental periods of time, such as a week, and then be at another facility a hundred or so miles away for a subsequent time period and so on to thereby maximize the availability of the mobile imaging units to many people. Such movement of the mobile imaging units may be on a schedule of incremental stays at varying locations throughout remote regions. Simultaneously, the medical facilities schedule patient visits for the mobile imaging units during their stay at a particular facility.

While such deployment of mobile imaging units has significant advantages, many significant problems are also associated with their usage. For example, FIG. 1 shows a typical mobile imaging unit at reference numeral 10, and as is apparent the unit 10 has the rugged exterior appearance of a highway freight trailer. To position the mobile imaging unit next to a medical facility 12, the unit 10 must be in a parking lot 14 adjacent to the facility 12. That gives rise to risks of vehicles traveling within the parking lot 14 accidentally hitting the mobile imaging unit 10. Therefore, the unit 10 is typically surrounded by unsightly barrier warnings 16, as better shown in FIG. 2, which shows a second similar mobile imaging unit 18 surrounded by vehicle barrier warnings 16, such as brightly colored chains and posts, etc. Much effort is put into making medical facilities appear attractive, with appealing exteriors and extensive landscape work. Positioning a mobile imaging unit 10, 18 in a parking lot adjacent such a medical facility 12 completely disrupts the appearance of the facility 12, and presents risks to both persons using the facility parking lot 14 and also to persons within the mobile imaging unit from vehicles traveling in the parking lot 14.

FIG. 3 shows the second mobile imaging unit 18 from a rear view so that an entrance 20 to the unit 18 is opened adjacent a second medical facility 22. The entrance 20 requires a patient to climb a significant height from the parking lot 14 to a base 24 of the unit 18. The base 24 of the mobile imaging unit 18 is comparable to a bed of a common freight trailer (not shown), and is used to provide the structural support for the imaging and/or medical equipment and related control machinery located upon the base 24. The base 24 is supported by mobile unit support wheels 26 above the parking lot 14 a substantial distance due to mechanical requirements of the mobile imaging unit 18.

Therefore, patients utilizing the mobile imaging unit 18 face additional risks inherent in climbing a steep entrance 20 to pass into the unit 18. While facility based wheel chair accessible ramps (not shown) and/or more elaborate entrances could be designed and deployed for use with the mobile imaging units 10, 18. The costs of such elaborate machinery are typically prohibitive, especially where the units 10, 18 are only resident at the medical facility 12 for short durations.

For patients being processed through such mobile imaging units 10, 18, host facilities must also adhere to clinical requirements by providing a waiting room, private administrative offices, a changing room, lavatories etc. As is apparent from FIGS. 1-3, the mobile imaging units provide little extra room for any waiting rooms or administrative offices to interview patients and process their medical documents. They also do not offer the patients adequate privacy, and consequently they may not be in compliance with HIPAA. Additionally, any changing rooms for patients to change out of their clothing to be properly examined by either a CAT scan or MRI within the units 10, 18 are extremely small, or often located some distance away within the medical facility 12, 22. It is common that patients therefore process through a waiting room, private administrative offices and a changing room within the medical facility 22 before being escorted out of the facility 22 through the outside weather and up the entryway 20 into the mobile imaging unit 18. Such challenging logistics for efficient use of the mobile imaging unit 18 presents significant discomfort and stress for patients. Some patients therefore simply decline to use a medical facility with only a mobile imaging unit 10, 18. Consequently, while mobile imaging units currently provide many benefits, they unfortunately also raise risks that limit their potential value.

SUMMARY OF THE DISCLOSURE

The Disclosure is a pre-engineered building for housing an integral mobile imaging unit within the building. The pre-engineered building includes a patient service enclosure and an adjacent mobile imaging unit enclosure sharing a common wall. The patient service enclosure includes a first front wall, a first rear wall opposed to the first front wall, a first side wall extending between the first front and first rear walls, and the common wall opposed to the first side wall and extending between the first front and first rear walls. A first floor extends between the first front, first rear, first side and common walls, and a roof extends over and between the first front, first rear, first side and common walls to define an interior patient service void within the patient service enclosure. The first floor is secured to the first front, first rear, first side and common walls and defines a plane a first distance above a bottom edge of the common wall.

The mobile imaging unit enclosure includes a second front wall, a second rear wall opposed to the second front wall, and a second side wall extending between the second front and second rear walls and opposed to the common wall. A second floor extends between the second front, second rear, second side and common walls and defines a plane about perpendicular to the bottom edge of the common wall. The roof also extends over and between the second front, second rear, second side and common walls to define an interior mobile imaging unit void within the mobile imaging unit enclosure.

The patient service void is configured to define one or more rooms to receive and process patients into the mobile imaging unit void, and the mobile imaging unit void is configured to selectively receive a mobile imaging unit through the second front wall and enclose the unit within the mobile imaging unit void. The mobile imaging unit is designed to have a base for supporting various types of medical modality equipment, such as CT, MRI, PET, PET/CT, etc. The base of the mobile imaging unit is supported above the second floor by wheels of rear axles, aluminum support stands or hydraulic rear legs between the rear axles and by the front landing gear of the unit. The base is supported above the second floor a distance between the base and the second floor that is about the same as the first distance. Therefore, the first floor of the patient service enclosure is about the same distance above the second floor as is the bed of the mobile imaging unit to thereby provide for patients moving from the patient service enclosure into the mobile imaging enclosure without need for any steps.

All of the interior and exterior walls and roof panels of the patient service and mobile unit enclosures are pre-engineered so that the walls are manufactured to include structural support components, exterior sheathing, and utility components prior to installation of the walls upon a foundation supporting the pre-engineered building. The phrase "utility components" in reference to the pre-engineered walls is to mean that the walls include any necessary electrical wiring, switches, electrical outlets, circuit breakers or related electrical components, any plumbing fixtures, such as pipes, valves, etc., and any heating and/or cooling fixtures, etc. Additionally, for purposes herein, the word "pre-engineered" is to mean that pre-engineered components include architectural and engineering design attributes necessary to be constructed in accordance with International Building Codes, and an ability to be constructed in panelized configurations in contrast to traditional construction methodologies.

Because the configuration of the mobile imaging units are similar and the requirements for processing patients through the units are likewise comparable, the pre-engineered building of the present disclosure can be quickly constructed in about three months without any major disruption of an adjacent medical facility. The resulting attractive, pre-engineered building enhances the overall look of the campus for the medical facility. More importantly, the pre-engineered building seamlessly integrates the mobile imaging unit within the mobile imaging unit enclosure with necessary patient services facilities within the patient services enclosure so that patients within the building need never be aware that they are entering a mobile imaging unit rather than a fully integrated imaging facility. For example, patients may enter a waiting room upon entering the patient services enclosure with an adjacent, private administrative room for processing patient documents. The patient may then proceed into a patient changing room within the patient services enclosure, and then pass through an enclosed passageway into the mobile imaging unit within the mobile imaging enclosure to be examined within the PET/CT, or MRI, etc.

In alternative embodiments of the pre-engineered building, the building may also include an enclosed walkway into the medical facility to provide ready transport of patients into and out of the building without any exposure to ambient weather. The second front wall or front wall of the mobile imaging unit enclosure may include an overhead door, or be a replaceable wall, to enable movement of the mobile imaging unit in and out of the building, for temporary positioning of the unit within the building, or for upgrading of the mobile imaging unit without any disruption of the pre-engineered building or the medical facility. Such movement of the mobile imagining unit into and out of the pre-engineered building also enables the facility to offer multi-modality technology, such as switching from MRI technology to PET/CT technology, etc.

Additionally, the pre-engineered building may provide for varying interior design configurations, such as expandable first back or side walls to offer an efficient expansion of the patient services enclosure to thereby satisfy evolving requirements of the medical facility. The patient services enclosure may also be pre-engineered so that a floor plan of waiting room administrative offices and/or changing rooms may be custom designed and/or quickly changed to meet specific requirements of a particular medical facility. The enclosed passageway between the patient service enclosure and the mobile imaging unit is also designed to be retractable and extendable, much like airport plane entryways, to further facilitate replacement of the mobile imaging unit within the pre-engineered building. Additionally, the roof of the building and/or the walls of the mobile imaging unit enclosure may be pre-engineered to provide necessary utility components for the mobile imaging unit, including for example any necessary ventilation components (HVAC—Heating, Ventilation and Air Conditioning) and specially designed cryogen exhausts, etc.

Accordingly, it is a general purpose of the present disclosure to provide a pre-engineered building for an integral mobile imaging unit that overcomes deficiencies of the prior art.

It is a more specific purpose to provide a pre-engineered building that will house integral mobile imaging unit(s) that minimizes patient risks of using the mobile imaging unit. The pre-engineered building also provides associated clinical and administrative support space in a patient service enclosure adjacent to the mobile imaging unit.

These and other objects and advantages of this disclosure will become more readily apparent when the following description is read in conjunction with the accompanying drawings.

DESCRIPTION OF THE PREFERRED EMBODIMENTS

Figure 4:
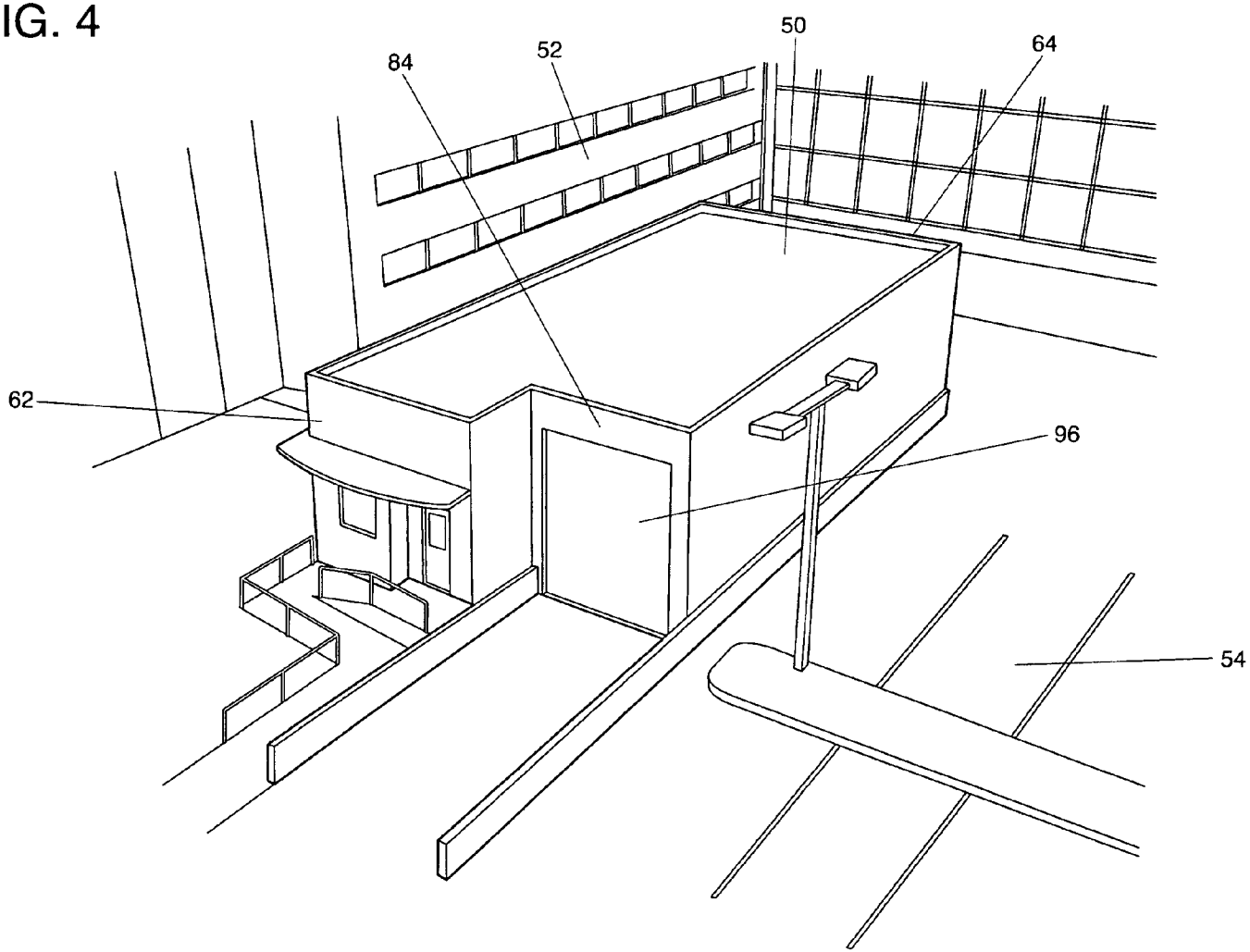
FIG. 4 is a raised perspective view of a pre-engineered building for an integral mobile imaging unit constructed in accordance with the present invention and located adjacent a medical facility, which may also be positioned as a stand alone building.
Figure 5:
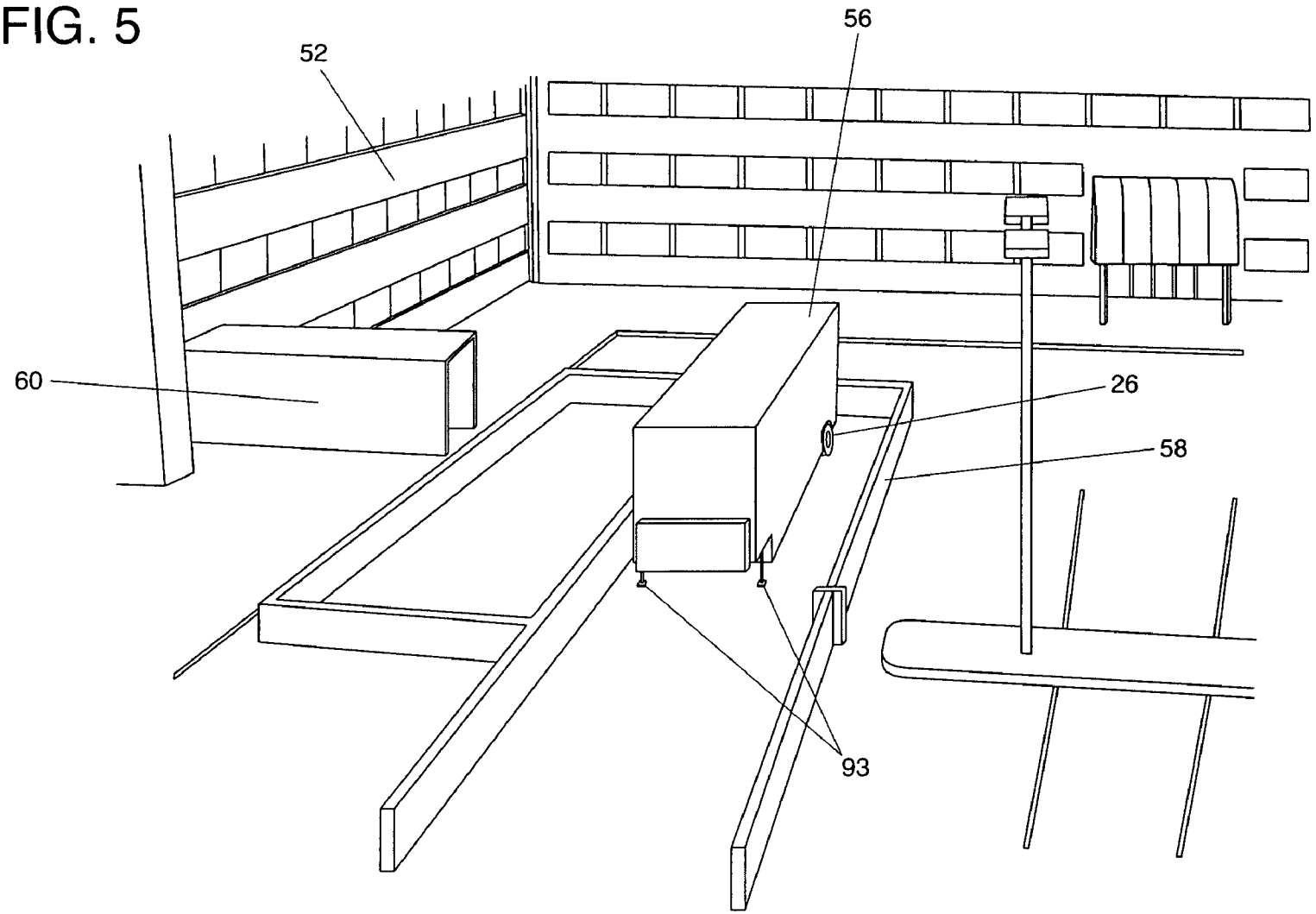
FIG. 5 is a raised perspective view of a mobile imaging unit surrounded by a foundation suitable for a pre-engineered building of the present disclosure.

Referring to the drawings in detail, a pre-engineered building for an integral mobile imaging unit is shown in FIG. 4 and is generally designated by the reference numeral 50. The building 50 is shown located adjacent a medical facility 52, and constructed within a parking lot 54 of the facility 52. For purposes of clarification, FIG. 5 shows a mobile imaging unit 56 surrounded by a foundation 58 appropriate for supporting the pre-engineered building 50. FIG. 5 is shown with the mobile imaging unit 56 within the foundation 58 to juxtapose relative dimensions of the mobile imaging unit 56 and the resulting pre-engineered building 50 of FIG. 4 that will house the unit 56. During actual construction and erection of the building 50, the mobile imaging unit 56 would not be within the foundation 58 as shown in FIG. 5. Because weather conditions vary from region to region, and because construction by-laws likewise vary, the foundation 58 of the building would not be pre-engineered, but could be constructed in allocated real estate on a medical facility campus with little difficulty. FIG. 5 also shows an enclosed walkway 60 extending from the medical facility 52 out and over the foundation 58.

Figure 6:
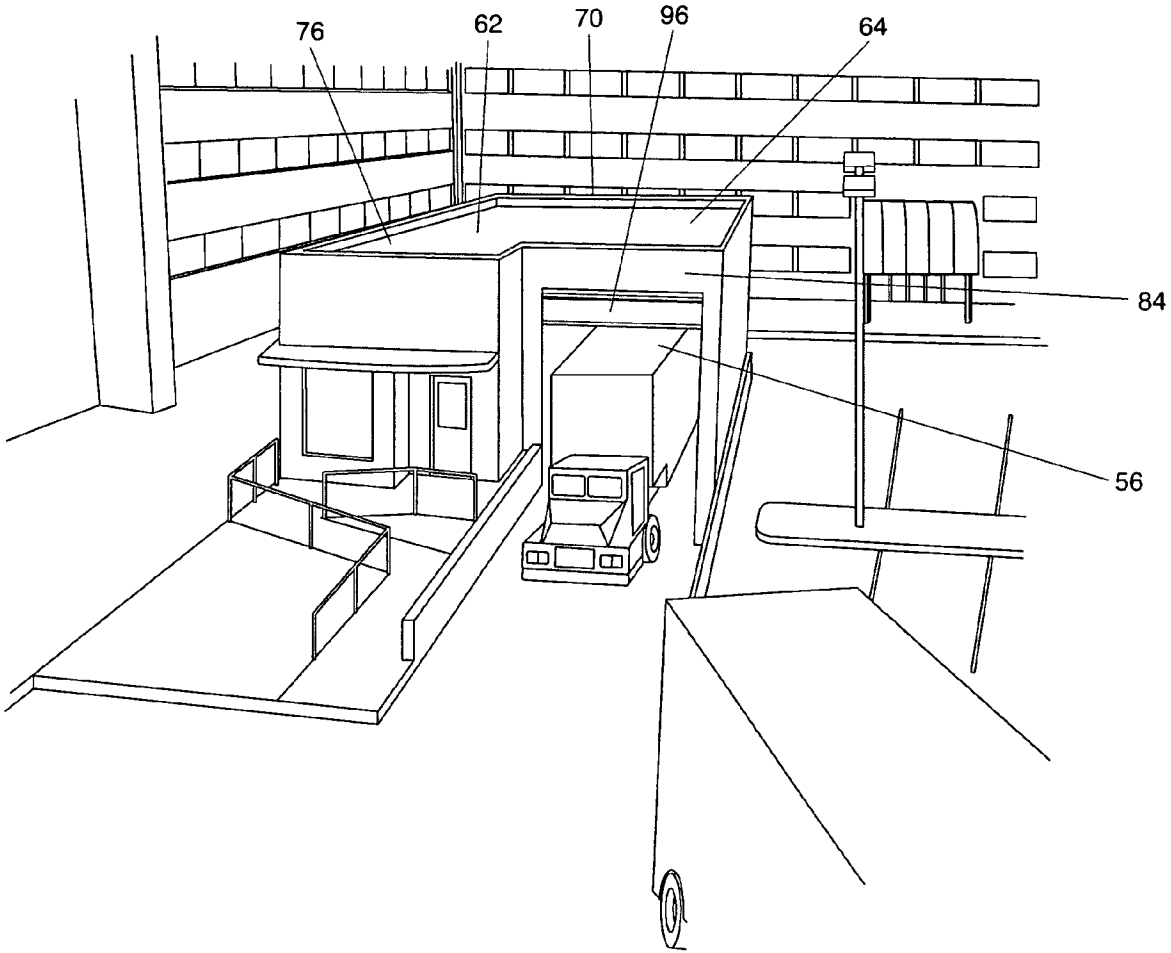
FIG. 6 is front perspective view of the FIG. 4 pre-engineered building, showing a front wall of the building opened and showing a mobile imaging unit being replaced within the building.
Figure 7:
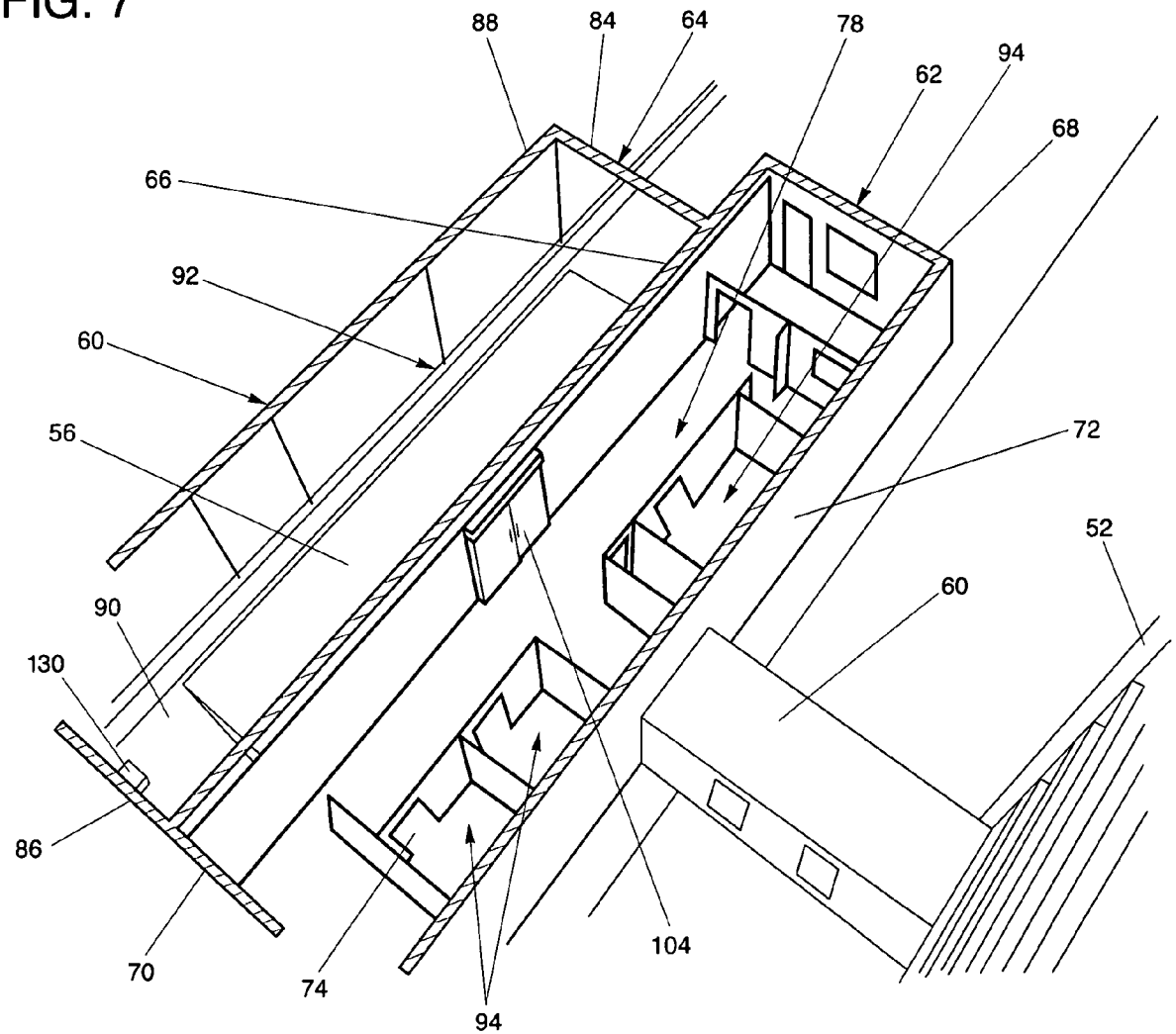
FIG. 7 is raised perspective view of the FIG. 4 pre-engineered building, showing a roof of the building removed and showing varying rooms within the building, and showing an enclosed walkway between the pre-engineered building and an adjacent medical facility.
Figure 8:
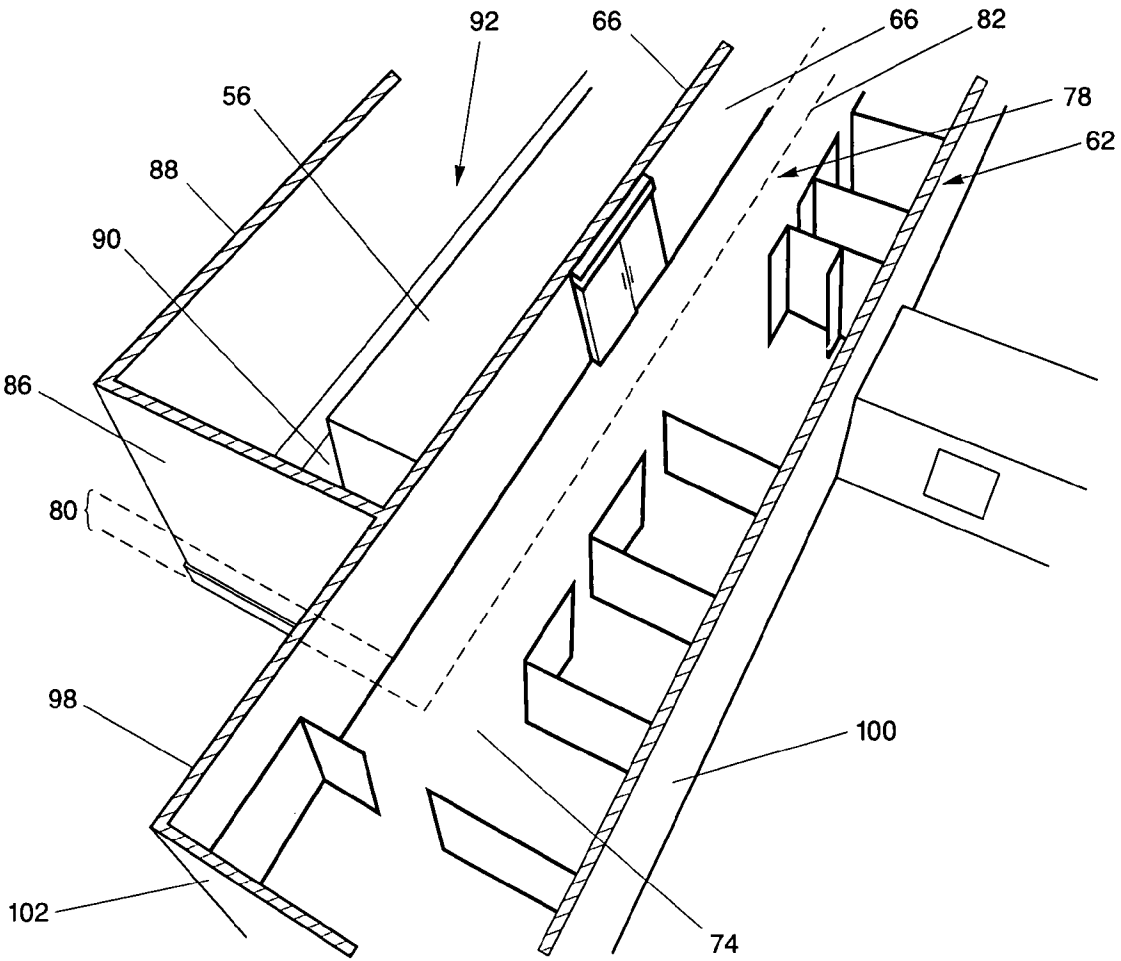
FIG. 8 is a raised perspective view of a pre-engineered building for an integral mobile imaging unit showing an expanded patient service enclosure.
Figure 9:
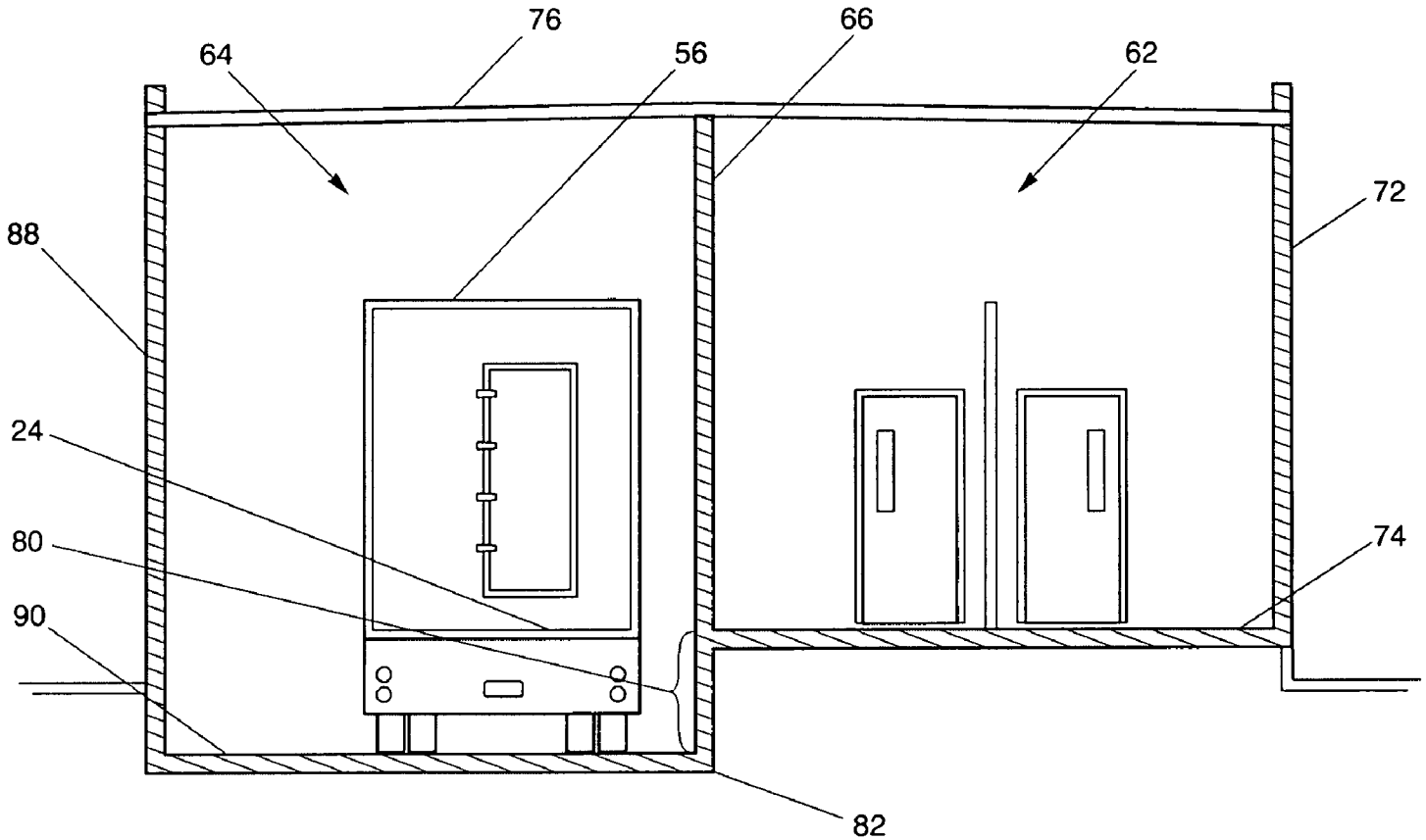
FIG. 9 is a rear plan sectional view of a pre-engineered building for an integral mobile g imaging unit showing a first floor and a second floor of the building.

As best shown in FIGS. 4, 6 and 7, the pre-engineered building 50 for an integral mobile imaging unit 56 includes a patient service enclosure 62 and an adjacent mobile imaging unit enclosure 64 sharing a common wall 66 (shown in FIG. 7). The patient service enclosure 62 includes a first front wall 68, a first rear wall 70 opposed to the first front wall 68, a first side wall 72 extending between the first front and first rear walls 68, 70, and the common wall 66 opposed to the first side wall 72 and extending between the first front and first rear walls 68, 70. A first floor 74 extends between the first front 68, first rear 70, first side 72 and common walls 66, and a roof 76 extends over and between the first front 68, first rear 70, first side 72 and common walls 66 to define an interior patient service void 78 within the patient service enclosure 62. The first floor 74 is secured to the first front 68, first rear 70, first side 72 and common walls 66 and defines a plane a first distance 80 above a bottom edge 82 of the common wall 66, as shown in FIGS. 8 and 9.

The mobile imaging unit enclosure 64 includes a second front wall 84, a second rear wall 86 opposed to the second front wall 84, and a second side wall 88 extending between the second front and second rear walls 84, 86 and opposed to the common wall 66. A second floor 90 extends between the second front 84, second rear 86, second side 88 and common walls 66 and defines a plane about perpendicular to the bottom edge 82 of the common wall 66. The roof 76 also extends over and between the second front 84, second rear 86, second side 88 and common walls 66 to define an interior mobile imaging unit void 92 within the mobile imaging unit enclosure 64.

Figure 1:
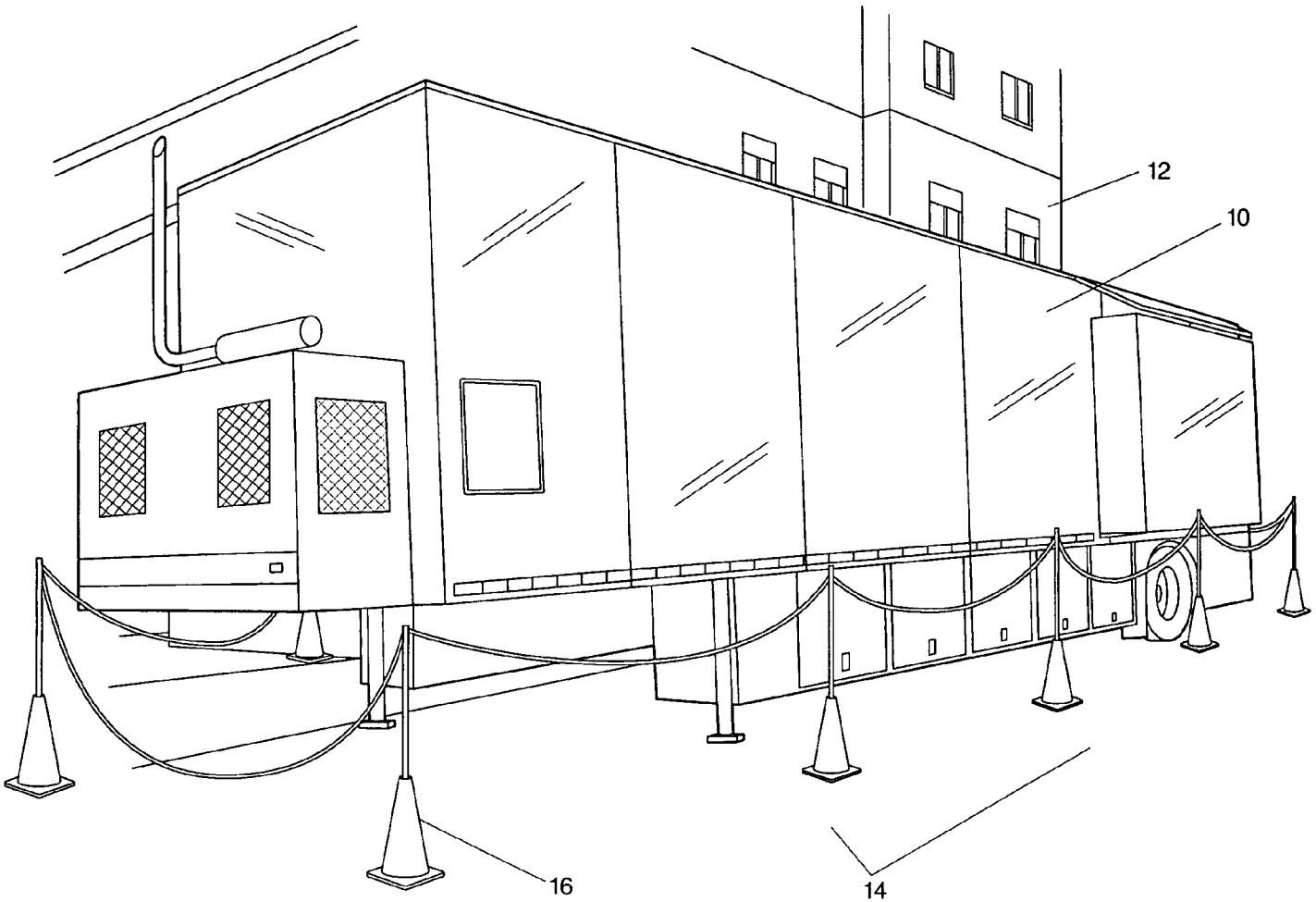
FIG. 1 is front perspective view of a prior art mobile imaging unit.
Figure 2:
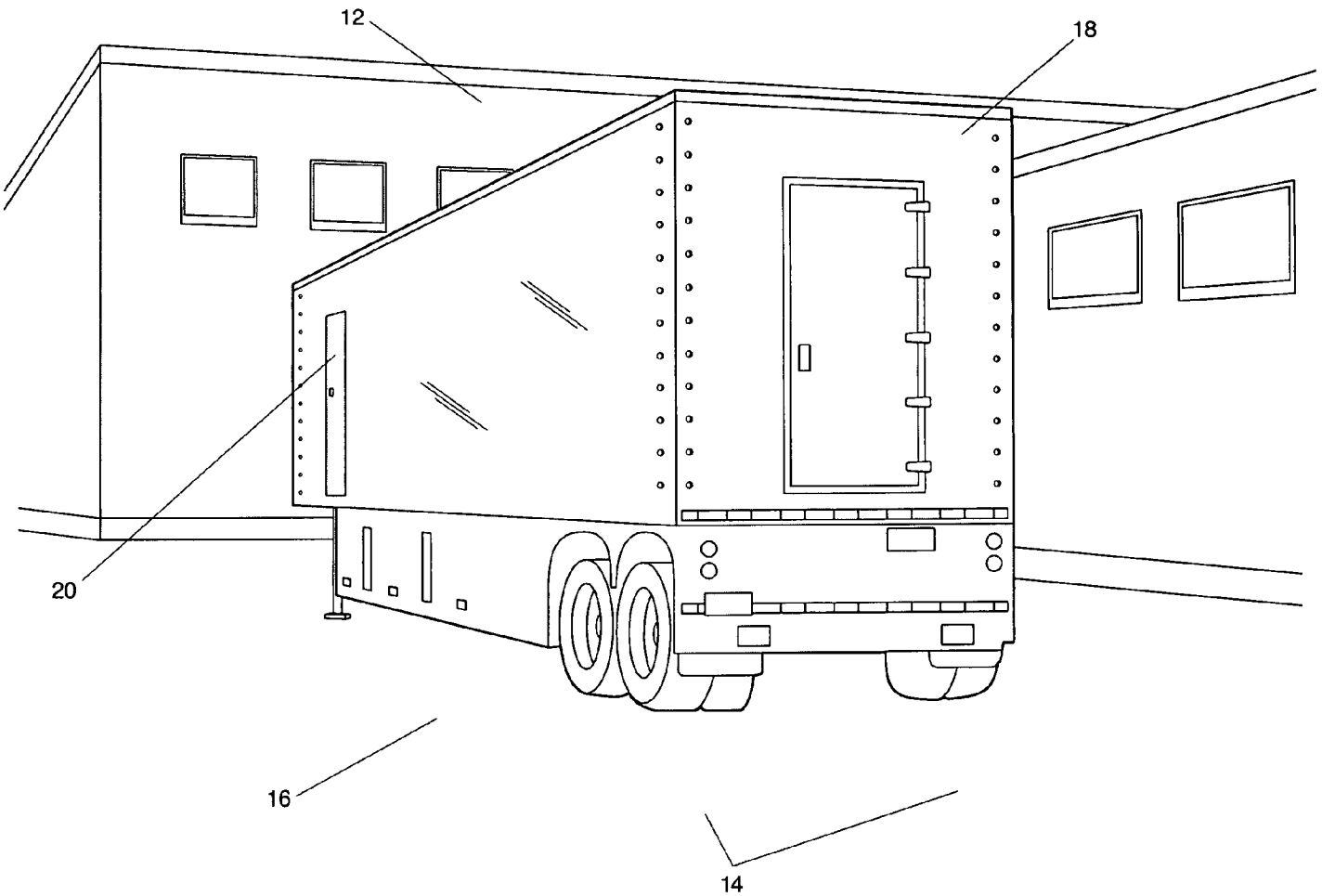
FIG. 2 is a rear perspective view of a prior art mobile imaging unit.
Figure 3:
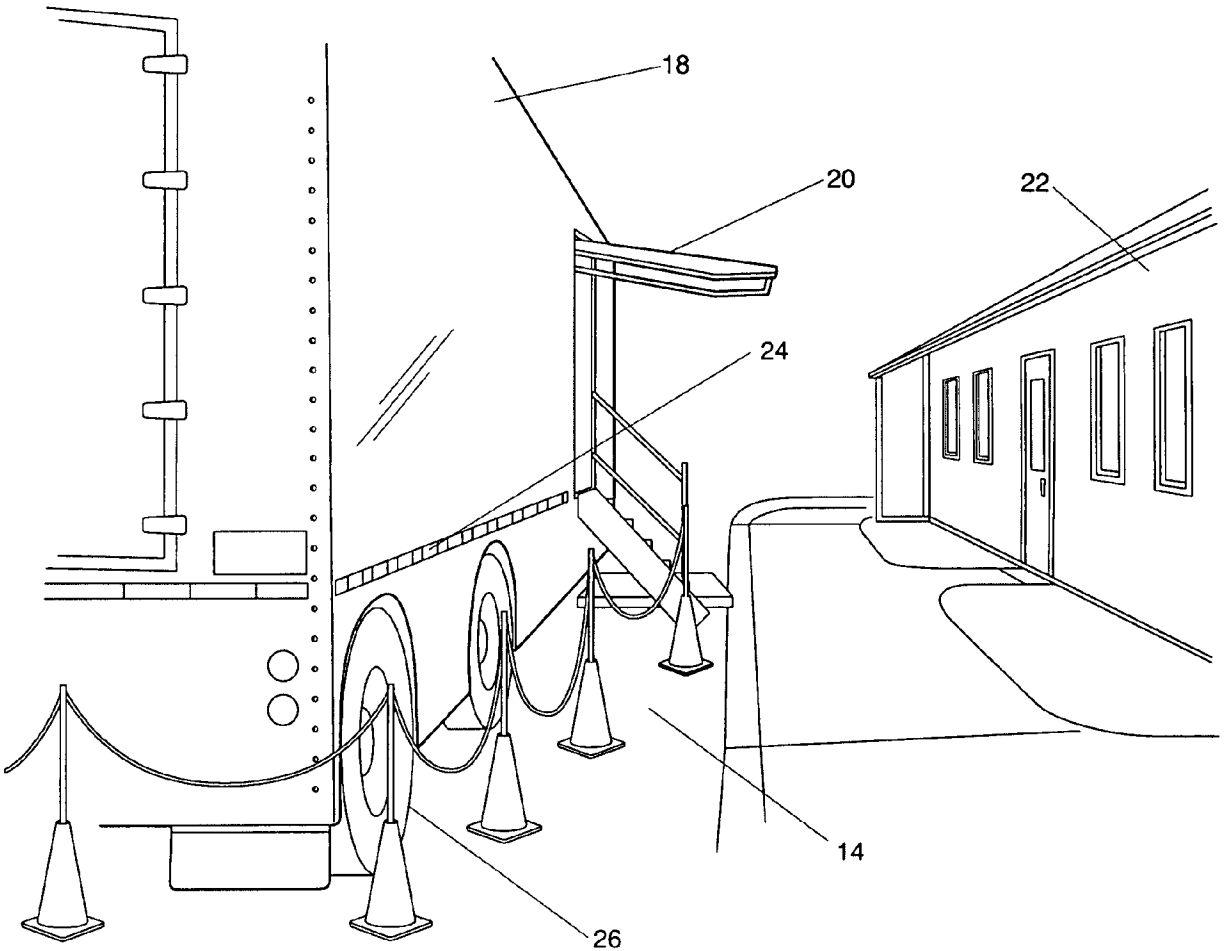
FIG. 3 a rear perspective view of the FIG. 2 mobile imaging unit, showing the unit with an open entryway.

The patient service void 78 is configured to define one or more rooms 94 to receive and process patients into the mobile imaging unit void 92. The mobile imaging unit void 92 is configured to selectively receive a mobile imaging unit 56 through the second front wall 84 and enclose the unit 56 within the mobile imaging void 92. The mobile imaging unit 56 has a base 24 (shown in FIG. 3 and 9) for supporting imaging and/or medical equipment (not shown), and the base 24 is supported by mobile imaging unit front landing gear 93, and rear aluminum support stands or hydraulic legs (not shown) located adjacent the rear axle support wheels 26 (shown if FIG. 3 and 5) above the second floor 90. The base 24 is supported a distance between the base 24 and the second floor 90 that is about the same as the first distance 80 (shown in FIG. 9). (For purposes herein, the word "about" is to mean plus or minus twenty per cent.) Therefore, the first floor 74 of the patient service enclosure 62 is about the same distance above the second floor 90 as is the base 24 of the mobile imaging unit 18, 56 to thereby provide for patients moving from the patient service enclosure 62 into the mobile imaging enclosure 64 without need for ascent or descent along any steps (not shown).

All of the walls 66, 68, 70, 72, 84, 86, 88 of the patient service and mobile unit enclosures are pre-engineered, and the roof 76 may also be pre-engineered, so that the walls and roof 76 are manufactured to include structural support components (not shown), applied exterior sheathing (not shown), and utility components (not shown) prior to installation of the walls upon the 58 foundation supporting the pre-engineered building 50. For purposes herein, the phrase "utility components" in reference to the pre-engineered walls 66, 68, 70, 72, 84, 86, 88 and 76 is to mean that the walls include any necessary electrical wiring, switches, electrical outlets, circuit breakers, smoke sensors, or related electrical components, any plumbing fixtures, such as pipes, valves, etc, and any heating and/or cooling fixtures, etc. Additionally and as recited above, the walls 66, 68, 70, 72, 84, 86, 88 of the patient service and mobile unit enclosures are pre-engineered, and the roof 76 may also be a pre-engineered component so that they include architectural and engineering design attributes necessary to be constructed and erected in accordance with International Building Codes, and include an ability to be constructed and erected in panelized configurations in contrast to traditional construction methodologies.

As shown best in FIGS. 4 and 6, the second front wall 84 of the mobile imaging unit enclosure 64 includes entry means for permitting selective entry and removal of the mobile imaging unit 18, 56 through the front wall 84, such as an overhead door 96 as shown in. FIG. 6. Alternatively, the entry means may be a removable wall, especially for circumstances wherein the mobile imaging unit is to remain within the pre-engineered building 50 for protracted periods of time.

FIG. 8 shows that the patient service enclosure 62 may include an expandable common wall segment 98, and expandable first side wall segment 100 and a removable-expandable first rear wall segment 102, and expanded roof 76 segment (not shown) to provide for expansion of the patient service enclosure 62 in the event of need for more space in that enclosure. The expandable common wall segment 98, expandable first side wall segment 100, removable-expandable first rear wall segment 102 and expanded roof 76 segment are all pre-engineered so that they are manufactured to include structural support components, exterior sheathing, and utility components prior to installation and erection of the expandable segments 98, 100, 102 adjacent patient service enclosure 62.

As shown in FIG. 7, the patient service enclosure 62 may also include a retractable-expandable passageway 104 for providing a seamless passage for patients into the mobile imaging unit 56, and for retracting to facilitate removal of the mobile imaging unit 56 from the mobile imaging enclosure 64. By being enclosed, such as modern airport retractable entryways for entering aircraft, patients may not even appreciate that they are entering a mobile imaging unit, and would not view any of the exterior of the mobile imaging unit 56, thereby substantially enhancing the overall appearance of the pre-engineered building 50 for the patients using the building 50.

Figure 10:
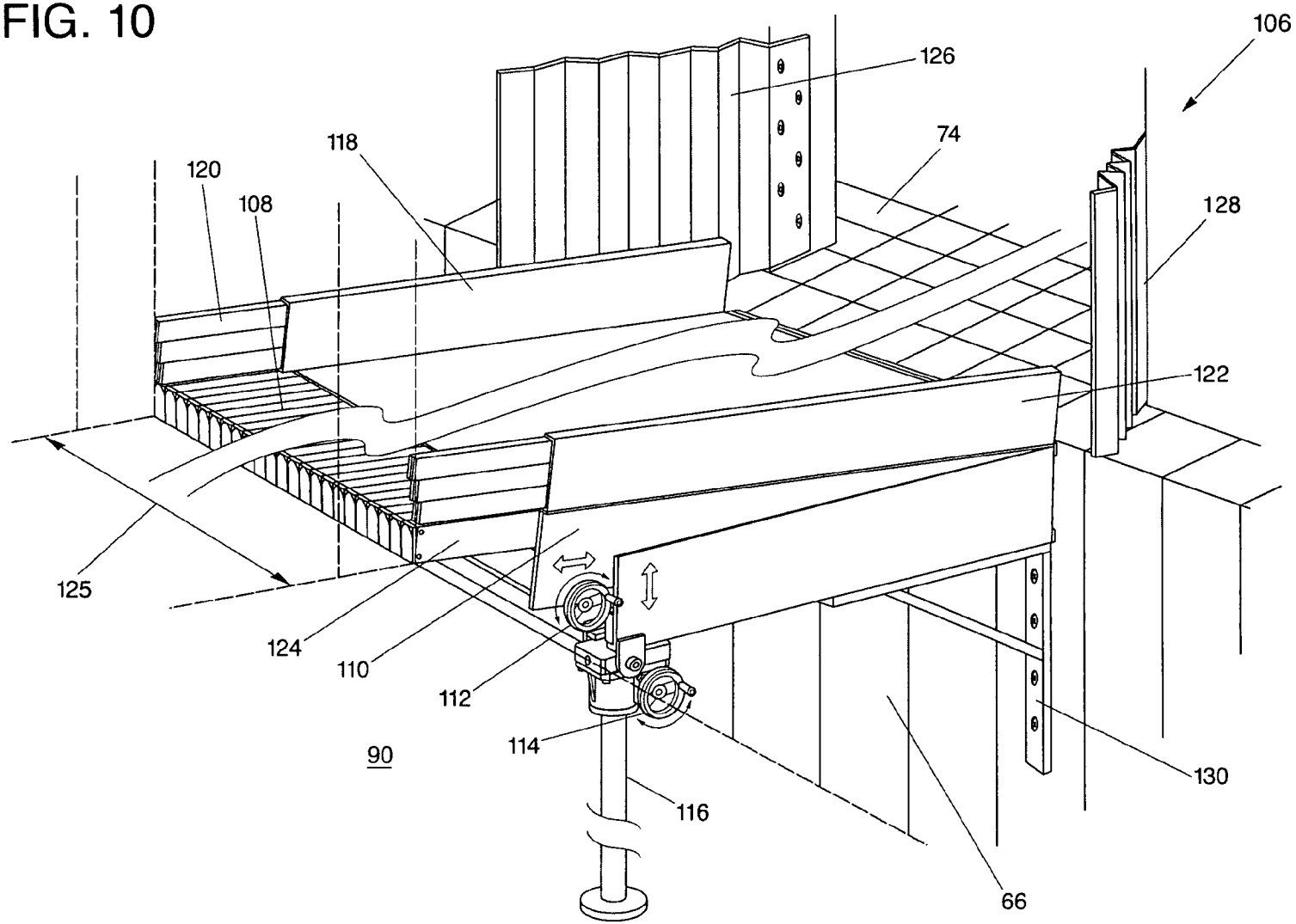
FIG. 10 is a raised perspective view of an extendable, variable pitch ramp secured between a first floor and a second floor of a pre-engineered building for an integral mobile imagining unit.

As shown in FIG. 10, in a preferred embodiment of the pre-engineered building 50, the retractable-expandable passageway 104 may include a extendable, variable pitch ramp 106 secured to the common wall 66 between the first floor 74 and the second floor 90 of the building 50. The ramp 106 is preferably constructed to include an extendable tongue 108 that extends from a ramp sleeve 110 upon activation of a tongue extending mechanism 112. The tongue extending mechanism 112 may be a hand crank (as shown in FIG. 10) integrated with a cable spring apparatus (not shown) within the sleeve 110, a jack screw and receiver (not shown) within the sleeve 110, or any mechanism capable of retractably extending the tongue out of and back into the sleeve 110, such as automated electric apparatus, hydraulic apparatus etc.

The ramp 106 may also include a sleeve pitch varying mechanism 114 for varying the pitch of the sleeve 106 to match any variations in support bases (such as the base 24 of the mobile imagining unit 56 as shown in FIG. 9) of differing mobile imaging units 18, 56. The sleeve pitch varying mechanism 114 may be a hand crank operated, jack post 116, using mechanical structures commonly found in automotive jacks used to raise heavy vehicles for tire changing. Alternatively, the sleeve pitch varying mechanism 114 may be any apparatus known in the art capable of varying the pitch of the sleeve 110, such as electrically operated jack screw assemblies, hydraulic jack assemblies, etc. The ramp 106 may also include a first side baseboard 118 with a first side baseboard extension 120 and an opposed second side baseboard 122 having a second side baseboard extension 124. The first and second side baseboard extensions 120, 124 are configured to be secured to the tongue 108, so that they extend and retract out of and back into the sleeve 110 with the tongue 108.

The retractable-expandable passageway 104 may also include a first adjustable wall 126 and secured to the common wall 66 and the first side baseboard 118 of the ramp 50 and an opposed second adjustable wall 128 also secured to common wall 66 and the second baseboard 122. An adjustable ceiling (not shown) may also be secured between the first and second adjustable walls 126, 128, so that the retractable-expandable passageway 104 provides a completely enclosed entry way between the patient service void 78 and the mobile imagining unit 56. The ramp 106 may also include additional sleeve pitch varying mechanisms (not shown), such as below the first baseboard 118, etc. to provide adequate support for the ramp 106. In a preferred embodiment the ramp 106 may have a ramp width 125 extending a shortest distance between the first and second baseboards 118, 122 of about fourteen feet in order to simultaneously accommodate patients, support personnel and medical equipment, and to accommodate variability in locations of entryways in mobile imagining units 56.

Because varying mobile imaging units 18, 56 may have an entryway 20 at differing locations along the units 18, 56, the ramp is preferably a particular minimum length that is a function of a shortest distance between the second front wall 84 and second rear wall 86, which represents the length of the mobile imaging unit enclosure 64. Specifically, in a preferred embodiment, the extendable, variable-pitch ramp 106 has a ramp width 125 that is at least fifteen percent of the length of the mobile imaging unit enclosure 64. If the length of the mobile imaging unit enclosure was about sixty feet, then the ramp width 125 would be at least nine feet. In an alternative embodiment, the ramp width 125 may be at least twenty percent of the length of the mobile imaging unit enclosure 64. For this embodiment, if the length of the mobile imaging unit enclosure was about sixty feet, then the ramp width 125 would be at least twelve feet. By having such a substantial ramp width 125, the pre-engineered building may accommodate all possible mobile imaging units 18, 56. A preferred length of the sleeve 110 of the ramp 106 extending perpendicular to the width is about four feet, wherein the tongue 108 extends out of the sleeve 110 about one foot. The ramp 106 may also include standard mechanical securing structures 130 to firmly secure the ramp 106 to the common wall 66.

In use of the extendable, variable pitch ramp 106, prior to a mobile imaging unit 56 being positioned within the mobile imaging unit void 92, the tongue 108 is retracted within the sleeve 110. After the mobile imaging unit 56 is positioned adjacent the common wall 66, an operator (not shown) opens an entryway 20 of the unit 56 and then extends the tongue 108 of the ramp 106 into the entryway 20. The operator then raises or lowers the sleeve 110 so that the tongue 108 rests firmly upon the base 24 of the mobile imaging unit 56. The operator also extends the first and second adjustable walls 126, 128 and adjustable ceiling (not shown) along the first and second baseboards 118, 122, to fully extend the retractable-expandable passageway 104 from the common wall 66 to be adjacent the mobile imaging unit 56.

The pre-engineered building 50 may also include a cryogenic exhaust-alarm system 130 shown schematically in FIG. 7. It is known that MRI modalities use extremely cold fluids. If such cryogenic fluids escape their normal containment and exhausts structures, they can pose extreme risks to humans. Mobile imaging units 56 having such cryogenic fluids include exhaust apparatus that direct the cryogenic fluids safely away from humans utilizing the unit 56. However, by enclosing such a MRI mobile imaging unit 56 within the mobile imaging unit enclosure 64, there is a risk of such cryogenic fluids exhausted from the MRI mobile imaging unit 56 becoming uncontained and thereby contaminating humans within the pre-engineered building 50. Therefore, the building 50 may also include the cryogenic exhaust-alarm system 130 to eliminate any risk of such contamination.

The system 130 may include any cryogenic exhaust-alarm apparatus and system means known in the art for directing flow of cryogenic fluids away from humans and for alerting such humans in the event of unsafe discharge of uncontained cryogenic fluids. For example, the cryogenic exhaust-alarm system 130 may include exhaust vents (not shown) that mate with exhaust vents (not shown) of the mobile imaging unit 56 to direct flow of cryogenic fluids out of the building 50. The mobile imaging unit enclosure 64 may include alignment apparatus (not shown), for example secured to and extending from the second rear wall 86 that signal when exhaust vents (not shown) passing through the roof 76 of the building 50 are aligned with exhaust pipes (not shown) of the mobile imaging unit 56. The system 130 may also include audio and visual (e.g. strobe light) alarms (not shown) located in various places within the building 50 to alert all humans of any cryogenic fluid discharge within the building 50. The alarms would be coupled with sensors (not shown) known in the art for detecting discharge of cryogenic fluids. The cryogenic exhaust-alarm system 130 may also include an independent battery charging sub-system (not shown) to provide electric maintenance of the system 130 and activation of the system alarms (not shown) in the event of disruption of ordinary electrical service (e.g., from the electric distribution grid). The system 130 may also include non-toxic, compressed gas in fluid communication with the system exhaust vents (not shown) within the roof 76 and configured to purge any cryogenic fluids out of the building 50.

By utilizing pre-engineered walls 66, 68, 70, 72, 84, 86, 88 and also a pre-engineered roof 76 to wrap somewhat standard sized mobile imaging units 18, 56 within a seamless integration of the mobile imaging unit 18, 56 adjacent an efficient patient service enclosure 62, the present pre-engineered building 50 provides many advantages for modern medical facilities 52. For example: overall costs are dramatically reduced compared to building a custom-engineered building; downtime for a medical facility to otherwise integrate modern imaging technology within the facility is virtually eliminated; providing an attractive pre-engineered building with seamless integration of the mobile imaging unit 18, 56 adjacent an efficient patient services enclosure 62 increases patient satisfaction and hence patient flow leading to increased revenue. Additionally, the pre-engineered building is designed to be HIPAA compliant. Also, the overall appearance of the medical facility campus is significantly enhanced compared to mobile imaging units 18, 56 standing alone. Finally, construction and erection of the pre-engineered building 50 within a medical facility campus can be accomplished in as little as three months. The present disclosure also includes a method of constructing and erecting a pre-engineered building utilizing the above described components.

In a preferred embodiment the pre-engineered building 50 may be configured so that a length of the patient service enclosure 62 is about sixty-nine feet, four inches, a width is about eighteen feet, eight inches, and a height is about eighteen feet, and a length of the mobile imaging unit enclosure 64 is about sixty feet, ten inches, a width is about seventeen feet, and the height is about eighteen feet. This gives rise to a total square footage of the building 50 being twenty-three hundred and twenty-five square feet. As described above however, the actual size of the pre-engineered building 50 may be reduced or expanded to accommodate specific needs of a facility While the present disclosure has been described and illustrated with respect to particular descriptions and illustrations of preferred embodiments of the pre-engineered building 50 for an integral mobile imaging unit 18, 56, it should be understood that the disclosure is not limited to the described and illustrated examples. Accordingly, reference should be made primarily to the attached claims rather than to foregoing description to determine the scope of the invention.

What is claimed is:

1. A pre-engineered building (50) for housing an integral mobile imaging unit (56), the pre-engineered building (50) comprising:

a. a patient service enclosure (62) including a first front wall (68), a first rear wall (70) opposed to the first front wall (68), a first side wall (72) extending between the first front and first rear walls (68, 70), a common wall (66) opposed to the first side wall (72) and extending between the first front and first rear walls (68, 70), a first floor (74) extending between the first front, first rear, first side and common walls (68, 70, 72, 66) a roof (76) extending over and between the first front, first rear, first side and common walls (68, 70, 72, 66) to define an interior patient service void (78) within the patient service enclosure (62), the first floor (74) being secured to the first front, first rear, first side and common walls (68, 70, 72, 66) a first distance (80) above a bottom edge (82) of the common wall (66);

b. a mobile imaging unit enclosure (64) including a second front wall (84), a second rear wall (86) opposed to the second front wall (84), a second side wall (88) extending between the second front and second rear walls (84, 86) and opposed to the common wall (66), a second floor (90) extending between the second front, second rear, second side and common walls (84, 86, 88, 66), the roof (76) also extending over and between the second front, second rear, second side and common walls 84, 86, 88, 66) to define an interior mobile imaging unit void (92) within the mobile imaging unit enclosure (64);

c. the patient service void (78) being configured to define one or more rooms (94) to receive and process patients into the mobile imaging unit void (92) through a passageway (104) defined within the common wall (66);

d. the mobile imaging unit void (92) being configured to selectively receive through the second front wall (84) and enclose within the mobile imaging void (92) a mobile imaging unit (56), the mobile imaging unit (56) having a base (24) for supporting medical equipment, the base (24) being supported above the second floor (90) a distance between the base (24) and the second floor (90) that is about the same as the first distance (80) so that the first floor (74) of the patient service enclosure (62) is about the same distance above the second floor (90) as is the base (24) of the mobile imaging unit (56);

e. wherein the walls (66, 70, 72, 74, 84, 86, 88) are pre-engineered so that the walls (66, 70, 72, 74, 84, 86, 88) are manufactured in panelized configuration to include structural support components, interior and exterior sheathing, and utility components prior to installation of the walls (66, 70, 72, 74, 84, 86, 88) upon a foundation (58) supporting the pre-engineered building (50);

f. an extendable, variable pitch ramp (106) secured adjacent the passage way (104) defined within the common wall (66), the ramp (106) configured to variably extend between the first floor of the patient services enclosure (62) and the base (24) of the mobile imaging unit (24);

g. wherein the extendable, variable pitch ramp (106) further comprises a tongue extending mechanism (112) configured to variably extend a tongue (108) of the ramp (106) out and back into a sleeve (110) of the ramp, and a sleeve pitch varying mechanism (114) configured to vary a pitch of the sleeve (106);

h. wherein the extendable, variable pitch ramp (106) has a ramp width (125) extending parallel to a plane defined by the common wall (66) that is at least fifteen percent as long as a length of the mobile imaging unit enclosure (64), the length of the mobile imaging unit enclosure (64) being a shortest distance between the second front wall (84) and the second rear wall (86) and parallel to the plane defined by the common wall (66); and, i. a cryogenic exhaust-alarm system means (130) for directing flow of cryogenic fluids out of the pre-engineered building (50), for sensing the presence of uncontained cryogenic fluids within the building (50), and for activating an alarm after sensing the presence of uncontained cryogenic fluids within the building (50).

2. A pre-engineered building (50) for housing an integral mobile imaging unit (56), the pre-engineered building (50) comprising:

a. a patient service enclosure (62) including a first front wall (68), a first rear wall (70) opposed to the first front wall (68), a first side wall (72) extending between the first front and first rear walls (68, 70), a common wall (66) opposed to the first side wall (72) and extending between the first front and first rear walls (68, 70), a first floor (74) extending between the first front, first rear, first side and common walls (68, 70, 72, 66) a roof (76) extending over and between the first front, first rear, first side and common walls (68, 70, 72, 66) to define an interior patient service void (78) within the patient service enclosure (62), the first floor (74) being secured to the first front, first rear, first side and common walls (68, 70, 72, 66) a first distance (80) above a bottom edge (82) of the common wall (66);

b. a mobile imaging unit enclosure (64) including a second front wall (84), a second rear wall (86) opposed to the second front wall (84), a second side wall (88) extending between the second front and second rear walls (84, 86) and opposed to the common wall (66), a second floor (90) extending between the second front, second rear, second side and common walls (84, 86, 88, 66), the roof (76) also extending over and between the second front, second rear, second side and common walls 84, 86, 88, 66) to define an interior mobile imaging unit void (92) within the mobile imaging unit enclosure (64);

c. the patient service void (78) being configured to define one or more rooms (94) to receive and process patients into the mobile imaging unit void (92) through a passageway (104) defined within the common wall (66);

d. the mobile imaging unit void (92) being configured to selectively receive through the second front wall (84) and enclose within the mobile imaging void (92) a mobile imaging unit (56), the mobile imaging unit (56) having a base (24) for supporting medical equipment, the base (24) being supported above the second floor (90) a distance between the base (24) and the second floor (90) that is about the same as the first distance (80) so that the first floor (74) of the patient service enclosure (62) is about the same distance above the second floor (90) as is the base (24) of the mobile imaging unit (56);

e. wherein the walls (66, 70, 72, 74, 84, 86, 88) are pre-engineered so that the walls (66, 70, 72, 74, 84, 86, 88) are manufactured in panelized configuration to include structural support components, interior and exterior sheathing, and utility components prior to installation of the walls (66, 70, 72, 74, 84, 86, 88) upon a foundation (58) supporting the pre-engineered building (50);

f. an extendable, variable pitch ramp (106) secured adjacent the passage way (104) defined within the common wall (66), the ramp (106) configured to variably extend between the first floor of the patient services enclosure (62) and the base (24) of the mobile imaging unit (24);

g wherein the extendable, variable pitch ramp (106) further comprises a tongue extending mechanism (112) configured to variably extend a tongue (108) of the ramp (106) out and back into a sleeve (110) of the ramp, and a sleeve pitch varying mechanism (114) configured to vary a pitch of the sleeve (106);

h. wherein the extendable, variable pitch ramp (106) has a ramp width (125) extending parallel to a plane defined by the common wall (66) that is at least fifteen percent as long as a length of the mobile imaging unit enclosure (64), the length of the mobile imaging unit enclosure (64) being a shortest distance between the second front wall (84) and the second rear wall (86) and parallel to the plane defined by the common wall (66);

i. a cryogenic exhaust-alarm system means (130) for directing flow of cryogenic fluids out of the pre-engineered building (50), for sensing the presence of uncontained cryogenic fluids within the building (50), and for activating an alarm after sensing the presence of uncontained cryogenic fluids within the building (50); and, j. wherein the passageway (104) comprises an extendable, enclosed passageway (104) configured to variably extend between the first floor of the patient services enclosure (62) and the base (24) of the mobile imaging unit (24).

* * * * *